US005553925A

United States Patent [19]

Merten et al.

[11] Patent Number: 5,553,925

[45] Date of Patent: Sep. 10, 1996

[54] APPARATUS FOR AUTOMATICALLY ADJUSTING THE CUTTING HORIZON OF A MINING EXTRACTION APPARATUS

[75] Inventors: Gerhard Merten, Lünen; Thomas Hoelken, Bergkamen, both of Germany

[73] Assignee: Westfalia Becorit Industrietechnik GmbH, Germany

[21] Appl. No.: 414,216

[22] Filed: Mar. 31, 1995

[30] Foreign Application Priority Data

Apr. 27, 1994 [DE] Germany ..... 44 14 578.0

[51] Int. Cl.[6] ..... E21C 27/34; E21C 35/10

[52] U.S. Cl. ..... 299/1.1; 299/1.6; 299/34.08

[58] Field of Search ..... 299/1.1, 1.6, 1.7, 299/32, 34.08

[56] References Cited

U.S. PATENT DOCUMENTS 3,779,604 12/1973 Heyer et al. ..... 299/34.08

FOREIGN PATENT DOCUMENTS

| | | | |
|---|---|---|---|
| 2534325 | 7/1981 | Germany . | |
| 3338114 | 5/1985 | Germany . | |
| 3509868 | 10/1985 | Germany . | |
| 3841524 | 10/1991 | Germany . | |
| 4234720 | 4/1994 | Germany . | |
| 280396 | 5/1976 | U.S.S.R. | 299/1.1 |
| 592982 | 2/1978 | U.S.S.R. | 299/34.08 |
| 1088845 | 10/1967 | United Kingdom | 299/1.1 |

*Primary Examiner*—David J. Bagnell
*Attorney, Agent, or Firm*—Vickers, Daniels & Young

[57] ABSTRACT

According to the invention, automatic adjustment of the cutting horizon of a cutter installation or other mining installation is effected with the aid of recognition sensors which detect the footwall rock interface and which are disposed distributed over the length of the cutter or machine guide, wherein the measuring signals from the recognition sensors are acquired by an electronic evaluation and control unit and are utilized in the sense of automatically controlling the adjusting cylinders.

80 Claims, 4 Drawing Sheets

APPARATUS FOR AUTOMATICALLY ADJUSTING THE CUTTING HORIZON OF A MINING EXTRACTION APPARATUS

TECHNICAL FIELD

This invention relates to an apparatus for automatically adjusting the cutting horizon of a mining machine, particularly a coal plough, which is guided along a machine guide at the face by means of hydraulic adjusting cylinders which adjust the machine guide into its position perpendicular to the stratification.

BACKGROUND

As is known, hydraulic adjusting or control cylinders are used for controlling the horizon or level of mining apparatus, with the aid of which cylinders the mining installation is tilted in the plane perpendicular to the stratification or its angular position in relation to the footwall horizon is adjusted, so that the mining machine which is guided on the face conveyor or on the machine guide is controlled either in the direction of a descent or in the direction of an ascent. For plough installations, the object is generally to control the level of cut of the plough so that the bottom pick of the plough always cuts on the footwall horizon, i.e. at the interface between the footwall rock and the coal seam, even if the seam stratification is irregular.

Amongst the various control systems which operate with hydraulic adjusting cylinders, those which have been proven in practice are primarily what are termed boom control systems or outrigger steering systems, in which the adjusting cylinders are integrated in boom rod assemblies attached articulated to the face conveyor on the stowing side, which boom rod assemblies are supported and guided in the advancing face support which generally consists of shield supports (see DE-OS 25 34 325, for example). In this respect the boom rod assemblies at the same time form the support advance mechanism, by means of which the face conveyor is moved in the direction of mining and the associated support frame is subsequently pulled behind.

In the control systems which have long been known for controlling the cutting horizon the adjusting cylinders are retracted or advanced by manual operation of their control valves if the plough runs out of the footwall horizon when the latter changes. This is often associated with oversteering of the plough installation, which can lead to deleterious loading of the conveyor and also of the support advance mechanism. Manual control of the adjusting cylinders does not enable faulty control operations reliably to be ruled out.

A method and a device are known for controlling the level of cut of a plough automatically (DE-PS 33 38 114). The cutting force loading of the cutter picks or the loading of the plough chain, and optionally the angular position of the face conveyor also, are determined in continuous operation, and the respective measured values are fed to an evaluation unit disposed on the plough control stand, which actuates the adjusting cylinders by way of a scheduled value/actual value comparison. A solution which can be used in practice for controlling the horizon of the plough installation is not given in the above document. Another disadvantage here is that the sensors are disposed on the plough body and are consequently subjected to considerable stresses when the plough is in operation. In addition, a separate power supply has to be disposed on the plough body, as does a transmitter which transmits the measuring signals via radio to the electronic evaluation and control unit.

With regard to plough installations, it is also known that the recognition sensors which detect the coal/footwall rock interface can be disposed on the chain-drawn plough body, the measuring signals of these sensors being utilised to adjust the bottom pick of the plough (DE-PS 35 09 868). With this arrangement also, a power supply and separate actuating drives with control elements for the plough tools have to be disposed on the plough body in addition to the recognition sensors.

For the recognition of the cutting horizon of mining machines such as coal ploughs or shearer loaders it has also been proposed in the prior art that optical sensor systems with sensor heads be used, which detect the different reflectances of footwall rock and coal and the measuring signals of which are utilised to control the tools of the mining machine (DE-PS 38 41 524). In addition to the optical sensor heads, a power unit for the supply of power, as well as transmitter and receiver stations for the sensor heads and control devices for adjusting the tools, has to be disposed on the mining machine or on the plough body in this case also.

Finally, a method and a device for controlling the horizon of a mining installation by computer-controlled adjustment of the stroke of the adjusting cylinders have been proposed in the prior art, in which, in order to move the height of the mining installation from an actual level to a scheduled level which is to be set, the stroke of the adjusting cylinders is automatically adjusted in steps by a control command which is sent to the level control electronics by the control computer according to the displacement of the mining installation over the displacement section towards the face, until the scheduled level is reached (German Patent Application P 42 34 720.3).

OBJECT OF THE INVENTION

The object of the present invention is to design an apparatus of the type cited at the outset so that the arrangement of sensors with a power supply system can be dispensed with, as can the radio transmission of the measured values, so that control of the level of the mining installation can be achieved overall with a significantly higher degree of operational reliability and without excessive overall cost. In this respect a preferred embodiment of the invention is directed towards plough installations which employ the known boom or outrigger control systems which have been proven in mining practice for the adjustment of the cutting horizon.

SUMMARY OF THE INVENTION

The aforementioned object is achieved according to the invention by the provision of sensors consisting of recognition sensors which detect the footwall rock interface, which are disposed distributed over the length of the machine guide and which are connected to the electronic evaluation and control unit via transmission lines which transmit their measuring signals.

According to the invention, the recognition sensors which detect the footwall rock/seam interface are not disposed on the mining machine itself which is guided along at the face, as was generally provided in the past, but instead are disposed on the machine guide, which is fixed or stationary in relation to the mining machine and which is generally installed on or connected with the conveyor (face conveyor) of the mining installation, particularly on cutting machines. The machine guide may also be formed from the movable conveyor itself, however. In their arrangement on the machine guide the recognition sensors are not subjected to excessive loading, which results in increased operational reliability of the overall system. A radio transmitter disposed on the mining machine for the transmission of the measuring signals from the recognition sensors can be dispensed with; this also contributes to the increased operational reliability of the control system. According to the invention, the recognition sensors may be disposed distributed over the length of the machine guide, preferably at mutual spacings of about 6–25 m in each case. In general, it is sufficient if the recognition sensors are disposed at spacings of 10–15 m in relation to each other. This arrangement of the recognition sensors enables the course of the footwall, and thus the working position of the mining machine or plough in relation to the footwall level, to be determined with sufficient accuracy over the entire length of the mining installation during mining operations. The mining installation can thereby be maintained on the desired cutting horizon even if the footwall course is irregular and if there are changes in the same. This is effected by the appropriate control of the adjusting cylinders via the electronic evaluation and control unit, which at the same time can be accommodated in a protected position separate from the mining machine, e.g. on the stowing side of the conveyor of the mining installation.

Known sensors can be employed for the interface recognition sensors. The known optical sensor heads which detect the different reflectances of footwall rock and coal are particularly suitable.

It is to be understood that the recognition sensors should be disposed at the most favourable position for the reliable determination of the footwall horizon, preferably directly in the region of the footwall. The recognition sensors are advantageously disposed on the face side of the movable conveyor of the mining installation, preferably at the base of the machine guide directly above the footwall. If the machine guide consists of a plough guide which is disposed on the face side on the movable conveyor, and which is provided in the known manner with a sliding track for the plough, which sliding track can be supported on the footwall and which preferably serves as a delimitation for the cut of the plough, the recognition sensors are advantageously disposed on this sliding track, preferably disposed protected in recesses in the sliding track or in the sliding rail forming the sliding track.

When use is made, as is preferred, of optical sensor heads which are situated at the ends of optical waveguides namely fibre optics, particularly fibre optic bundles, transmitter stations which are equipped with a light source, e.g. a light-emitting diode or a laser diode, and the receiver stations which receive light via the waveguides or electric light cables which is reflected at the interface, may be disposed on the machine guide or on the conveyor which comprises the latter, e.g. on the stowing side of the same. The optical waveguides leading to the sensor heads may then be guided through below the conveyor to the stowing side of the latter.

The electronic evaluation and control unit receives the measuring signals from the recognition sensors and processes these measuring signals to give control signals for the electrohydraulic actuation of the adjusting cylinders. In principle it is possible to assign a separate electronic evaluation and control unit to each recognition sensor, which evaluation and control unit thereby controls one adjusting cylinder or even a plurality of adjacent adjusting cylinders. Instead of this, however, a common electronic evaluation and control unit may also be associated with a group of recognition sensors, and accordingly with a group of adjusting cylinders which are situated over the longitudinal range of these recognition sensors. An electronic evaluation and control unit may also be employed which is common to all the recognition sensors of the machine guide and to all the hydraulic adjusting cylinders. It is further recommended that the electronic evaluation and control unit be provided with an electronic device for determining average values from the measuring signals which are supplied within a defined time interval, the adjusting cylinders being controlled according to these average values in the sense of adjusting or returning the mining installation to the required cutting horizon of the mining machine.

It is further recommended that displacement measuring sensors are associated with the adjusting cylinders, which measure the piston stroke of the latter, the displacement measurement signals being fed to the electronic evaluation and control unit, which controls the piston stroke of the adjusting cylinders in accordance with the recognition signals from the recognition sensors and depending on the displacement, and which therefore controls the stroke in a metered manner.

BRIEF DESCRIPTION OF THE FIGURES

Further design features of the invention follow from the description given below of the example of a non-limiting embodiment which is illustrated in the drawings, where.

DESCRIPTION OF PREFERRED EMBODIMENTS

Figure 1A:
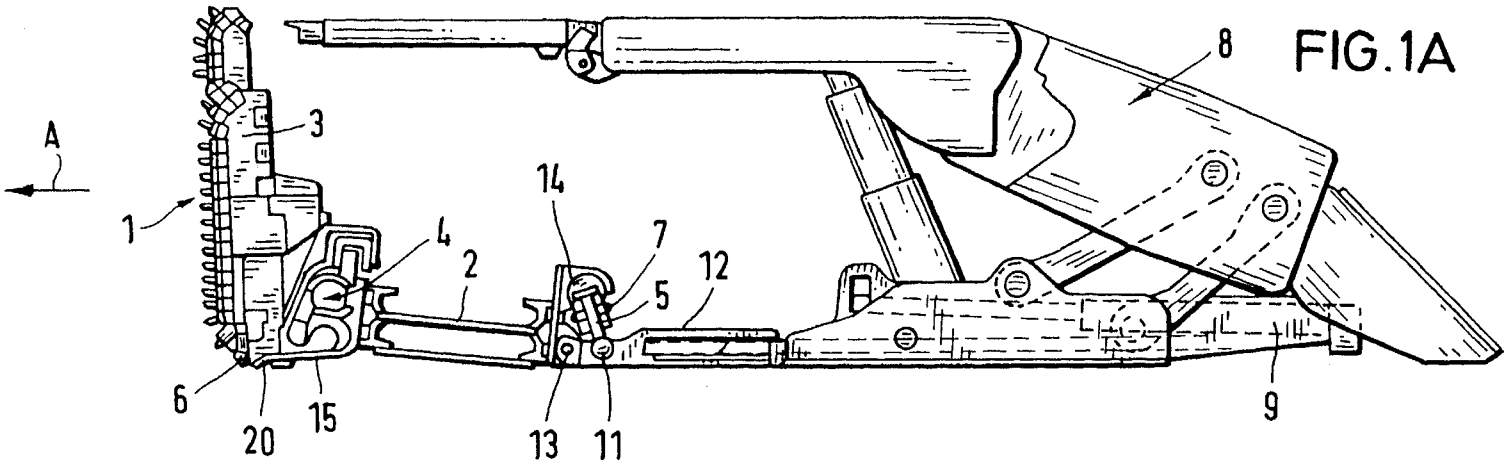
FIGS. 1A and 1B illustrate, as a cross-section through a mining face, a plough installation of known basic construction having a boom or outrigger control system for adjusting the cutting horizon of the plough into different control positions.
Figure 1B:
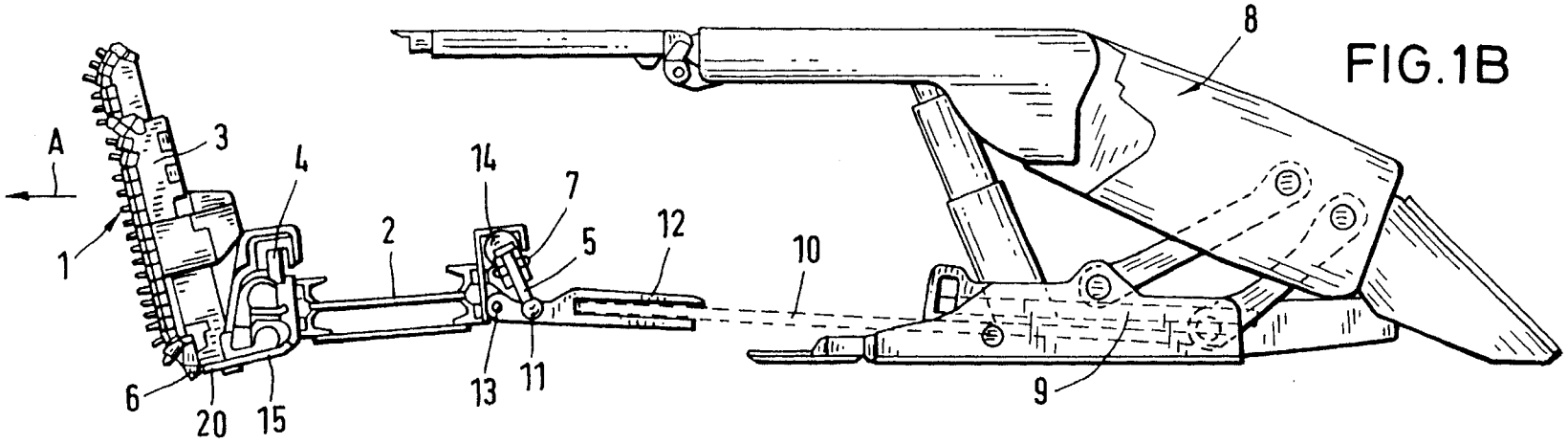
Figure 2:
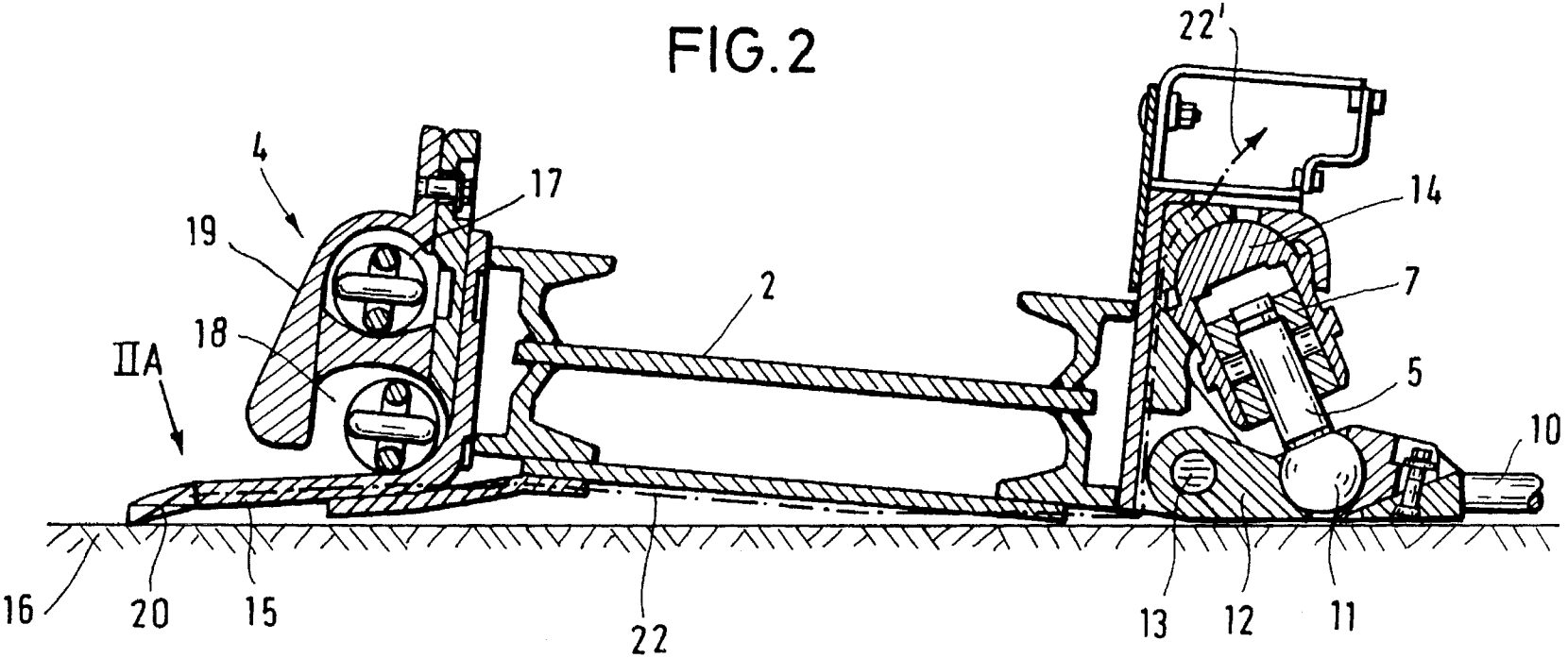
FIG. 2 is a cross-section, on an enlarged scale, through the plough installation shown in FIGS. 1A and 1B, with recognition sensors disposed on the machine guide, according to the invention.
Figure 2A:
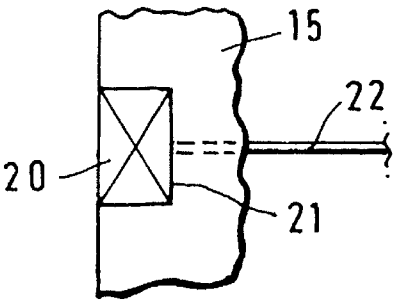
FIG. 2A is a partial plan view of the footwall rail of the plough guide, which forms a sliding track for the plough, in the direction of arrow IIA in FIG. 2.

The plough installation shown in FIGS. 1A, 1B and 2 is of known basic construction. It consists of a face conveyor 2 in the form of a scraper chain conveyor, which is placed in front of the coal face 1 and which can be moved in the direction of face advance A, and on which a coal plough 3 is guided which loads the coal mined by being cut from the face 1 into the face conveyor 2, which conveys the coal away from the mining operation. In the preferred embodiment which is illustrated, a plough guide 4 is installed as a machine guide on the face side on the face conveyor 2. The plough 3 is compulsorily guided on the plough guide 4, in which the driven plough chain is guided in chain channels disposed one above the other.

Hydraulic adjusting cylinders 7 are used in the known manner for controlling the horizon or level of the plough installation consisting of the face conveyor 2, plough 3 and plough guide 4. These hydraulic adjusting cylinders 7 are distributed over the length of the face conveyor 2 on the stowing side and are attached articulated to the face conveyor. The adjusting cylinders 7 are a component of a known boom or outrigger control system, of the type of construction according to DE-OS 25 34 325, for example. In this respect the adjusting cylinders 7 are a component of the support advance mechanisms. The advancing hydraulic support frames, which are in the form of support shields and which are each connected to the face conveyor 2 by their advance mechanisms, are denoted by 8. Each of the advance mechanisms has at least one advance cylinder 9 and a boom or outrigger rod assembly 10 which is supported in the support and is guided in the face direction A, the advance cylinders 9 in turn being attached articulated firstly to the bottom stay of the support frame 8 and secondly to the end of the boom rod assembly 10 on the stowing side. The piston rods 5 of the adjusting cylinders 7 are supported in joints 11 on a head piece 12 of the boom or outrigger rod assembly 10. The support advance mechanisms are each attached to the face conveyor 2 on the stowing side so that they can swing upwards, with the head piece 12 of their boom rod assembly in a connecting joint 13. In the embodiment illustrated the adjusting cylinders 7 are attached by the ends of their piston rods to the head piece 12 of the associated boom rod assembly, whilst they are attached to the face conveyor 2 on the stowing side with their cylinder parts in joints 14 constructed as socket joints. The arrangement is effected in the known manner so that the plough installation is moved in the face direction A by the retraction and extension of the advance cylinders 9, and the support frames 8 can consequently be pulled behind by the full stroke of the advance cylinders of the mining installation. By the action of pressure on the adjusting cylinders 7, which are constructed as double-acting cylinders, the angular position of the constructional unit consisting of the face conveyor 2 and the plough guide 4 can be adjusted in the plane perpendicular to the stratification, an adjustment of the cutting horizon of the plough 3 being made by way of the respective angular position. FIG. 1A shows the plough installation in its neutral control position, in which the plough guide 4 is situated in a position in which the bottom cutters 6 of the plough 3 cut at footwall level. FIG. 1B shows an adjustment of the plough installation in a direction of a descent, which is effected by pressurising the adjusting cylinders 7 in their direction of extension. In this connection the conveyor 2 is raised anti-clockwise on the stowing side and the plough guide 4 installed on the face side of the conveyor is thus tilted so that the plough 3 is adjusted in the direction of descent during its mining operation.

Boom or outrigger control systems are generally designed so that it is possible to control the plough both in the direction of a descent and in the direction of an ascent, control in the direction of an ascent being effected by pressurising the adjusting cylinders 7 in their direction of retraction. In each control position the plough installation is supported, via the boom or outrigger rod assembly 10, on the stowing side behind the conveyor 2 in the support 8.

As shown in FIG. 2 in particular, the plough guide 4 which serves for the compulsory guidance of the coal plough 3 comprises sliding rails 15 directed towards the face and forming a sliding track for the plough 3. These sliding rails can be employed in the known manner as delimitations for the cut of the plough, and can serve to support the plough installation on the footwall 16. The sliding rails 15 are situated below a cover 19 for the chain channels 17 and 18 of the driven cutter chain, which cover closes the chain channels on the face side. The sliding rails 15 are inclined at an acute angle to the plane of the footwall 16, and their free rail ends may be supported on the footwall 16 provided that the cutter installation is situated in the neutral position as shown in FIG. 1A or in the descent position as shown in FIG. 1B. It can also be seen from FIG. 2 that recognition sensors 20 are disposed on the sliding rails 15. The recognition sensors 20 are situated at the free ends of the sliding rails 15 in the immediate vicinity of the footwall 16. As illustrated in FIG. 2 they are situated in pocket-like recesses 21 at the ends of the sliding rails 15. Recognition sensors 20 are disposed, at spacings in relation to each other which are preferably about 10–15 m but may also be larger or smaller, over the length of the face conveyor 2 and thus over the length of the plough installation, on the sliding rails 15 of the plough guide sections which are installed on the trough sections. The recognition sensors 20 scan the footwall rock immediately in front of the face 1, and their measuring signals are utilised for controlling the plough installation, i.e. for the automatic adjustment of the cutting horizon of the plough 3 by corresponding actuation of the adjusting cylinders 7.

The recognition sensors 20 which detect the footwall rock/coal interface preferably consist of optical sensor heads known in the art which are disposed at the ends of optical waveguides (fibre optics) 22 and the mode of operation of which is based on the different reflectances of footwall rock and coal.

Optical sensor systems such as these are known from DE-PS 38 41 524, reference to the content of the disclosure of which is made here. In the embodiment illustrated, as is merely indicated schematically in FIG. 2, the optical waveguides or fibre optics 22 consisting of optical fibre optic bundles are led from the recognition sensors 20, which consist of optical sensor heads and which are embedded in the sliding rails 15, under the conveyor 2, the lower run of which is closed off, to the stowing side of the latter, and lead at their stowing side ends 22' to an electronic evaluation and control unit.

Figure 3:
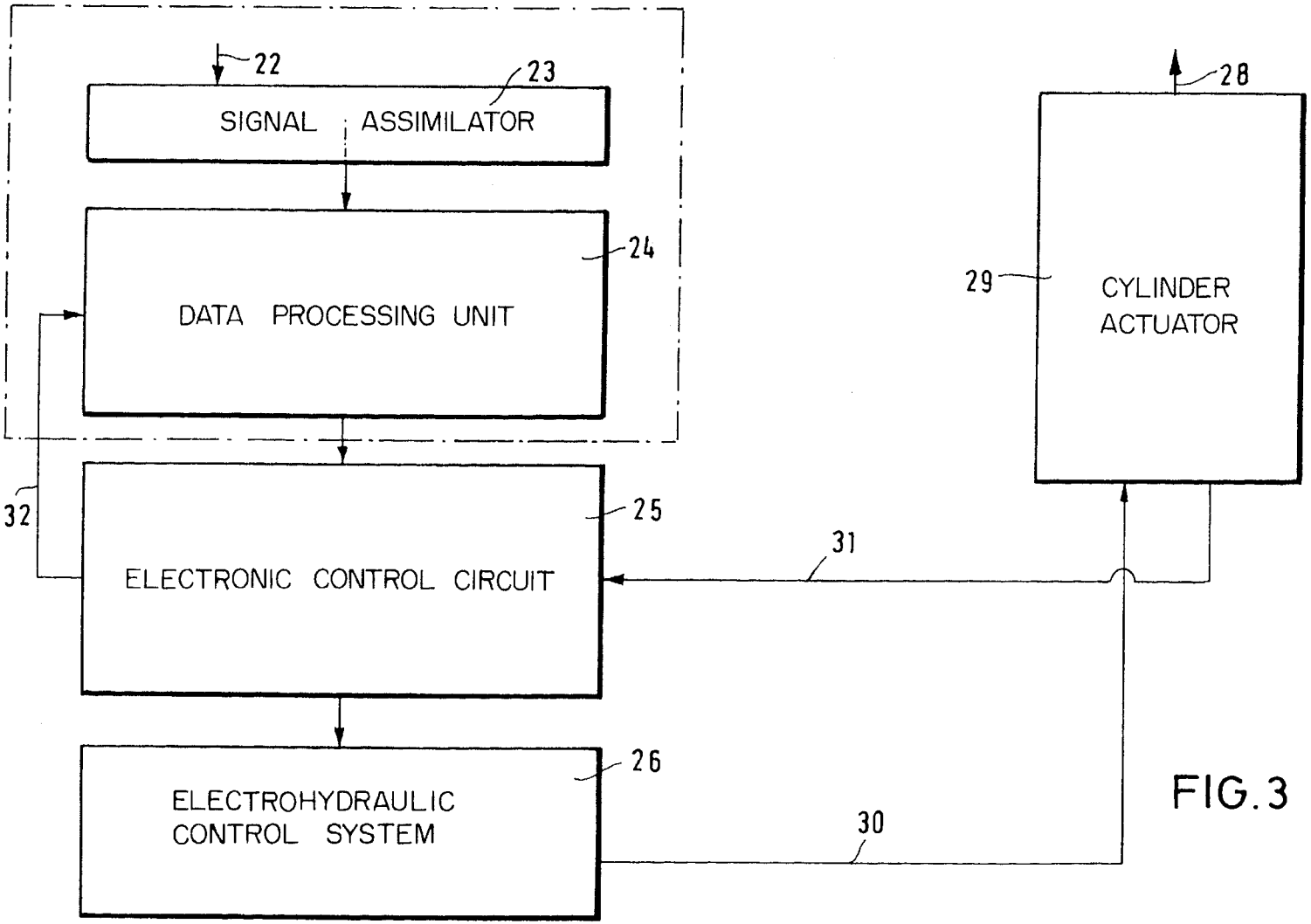
FIG. 3 is a simplified block circuit diagram of the controller for automatic adjustment of the cutting horizon.

The construction of the controller having the electronic evaluation and control unit is shown in FIG. 3. The optical waveguide or fibre optics 22 of the recognition sensor 20 is connected to a device 23 for the acquisition of the signals supplied by the recognition sensor, by means of which the position of the plough installation is determined in relation to the footwall level 16, in order to enable corresponding control of the hydraulic adjusting cylinders 7 to be effected if need be. The device 23 is a component of an electronic data processing unit 24, which forms average values from the measuring signals from the recognition sensor 20, wherein an electrical signal is derived from these average values in the sense of controlling the plough installation in the direction of a descent or in the direction of an ascent. An electronic control circuit 25 processes the signals from the data processing unit 24 and supplies a control current to an electrohydraulic control system 26, which is connected to a hydraulic pressure supply system and which actuates the associated adjusting cylinder 7 via a line 28 according to the result of the measured value, in the sense of a retraction or an extension of the adjusting cylinder. The devices 23 to 26 jointly form the electronic evaluation and control unit for the automatic control of the adjusting cylinders, which are pressurised by the electrical switching of associated electromagnetic valves via the electrohydraulic control system 26, which may also be a component of the electrohydraulic support control system. A device 29 is associated with the adjusting cylinders 7 which actuates the adjusting cylinders via the electrohydraulic control system 26 and which for this purpose is connected via an electrical line connection 30 to the electrohydraulic control system 26. The device 29 is preferably constructed so that when actuating the adjusting cylinder 7 it effects a defined piston stroke of the latter, so that the actuated adjusting cylinder is extended or retracted in a metered manner, the piston stroke position advantageously being displayed simultaneously on the device 29. When the adjusting cylinder 7 is actuated the pressure in its actuated cylinder space and also the piston stroke of this cylinder can be fed, via a line connecting devices 25 and 28, as information to the electronics 25, which feeds this pressure and stroke displacement signals via a line connection 32 to the data processing unit 24. As mentioned above, the data processing unit supplies the electrical control signal "descend" or "ascend" to the plough installation. The system described may also operate as an control loop adjusting device. The measurement of the piston stroke of the adjusting cylinders can be made with the aid of displacement measuring sensors associated with the latter, whilst the pressure measurement is made by pressure measuring sensors.

In particular, it is essential that the recognition sensors 20 scan the footwall level in continuous operation and at the same time feed their measured values to the electronic evaluation and control unit, which determines the direction for the control of the adjusting cylinders 7 and therefore their adjustment in a direction of ascent or descent, and which supplies control signals which are utilised for the electrohydraulic control of the adjusting cylinders 7 in a direction of ascent or descent.

Figure 4:
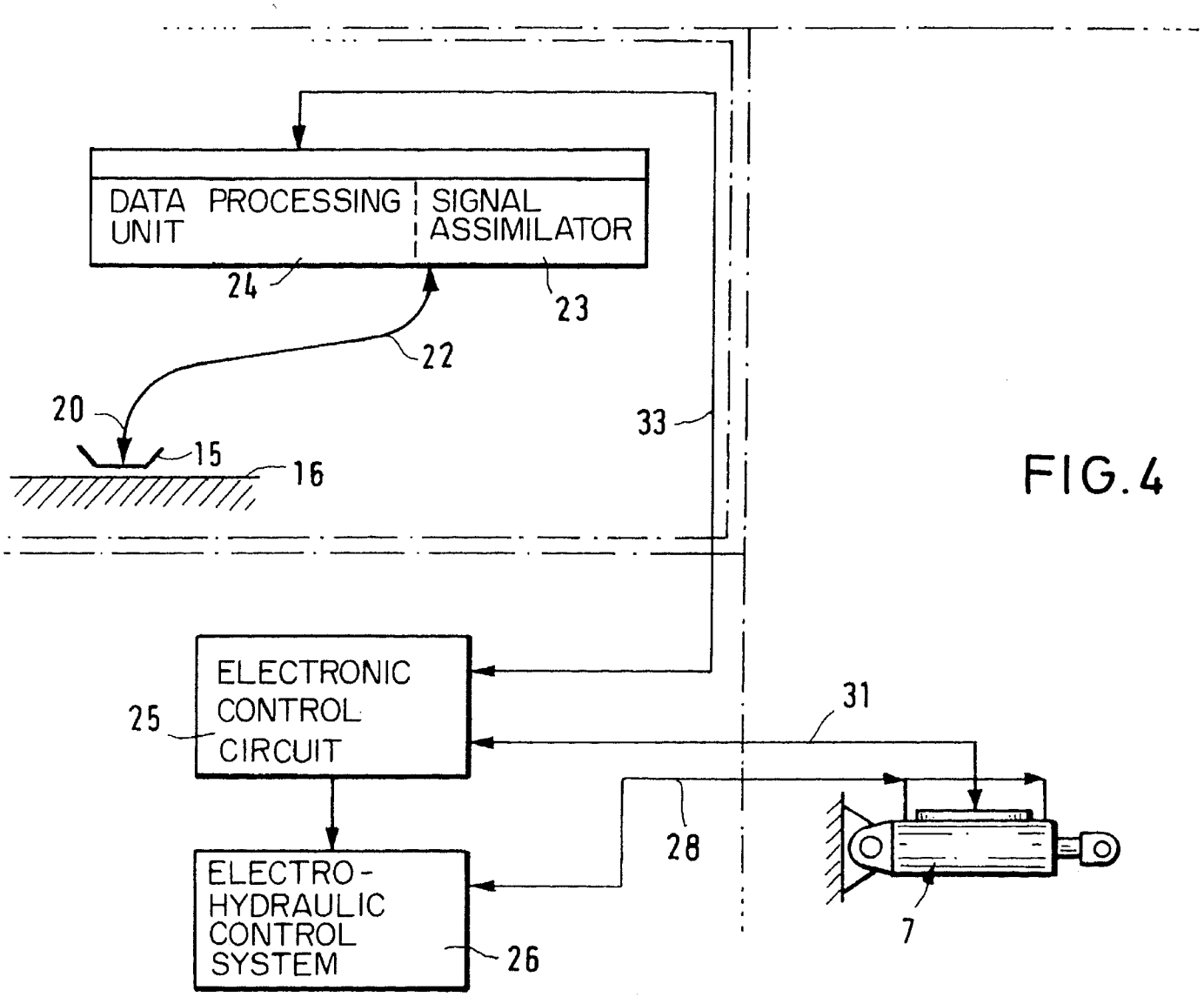
FIG. 4 is also a block circuit diagram, which illustrates the basic construction of the electronic evaluation and control unit of a cutting level control system according to the invention.

FIG. 4 illustrates, in simplified form, the automatic adjusting cylinder control system with the electronic evaluation and control unit. The recognition sensor 20 is also connected here via its optical wave guide or fibre optics 22 to the data acquisition unit 23 and the data processing unit 24, in order to determine the control data for the control of the adjusting cylinders from the measuring signals. The control data are fed via an electrical line 33 to the electronics unit 25, which in turn controls the associated adjusting cylinder 7 via the electrohydraulic control system 26 and the line connection 28 in the sense of adjusting the plough installation to the respective footwall level. The stroke and the position of the piston of the adjusting cylinder 7 are determined via corresponding sensors and are fed as information via line 31 to the electronics 25 in order to effect accurate control of the adjusting cylinder 7 in the control direction derived from the measuring signals of the recognition sensor 20.

As mentioned above, an electronic evaluation and control unit of the type described may be associated with each of the recognition sensors 20 disposed on the common plough guide 4. In this respect, either only a single adjusting cylinder 7 situated in the scanning region of the recognition sector is controlled, or a group of adjacent adjusting cylinders 7 is controlled, which adjusting cylinders are situated in the scanning region of the recognition sensor. However, it is also possible to provide a common electronic evaluation and control unit for all the recognition sensors 20, by means of which the individual adjusting cylinders 7 are actuated individually or in mutually independent groups in accordance with the measured results from the recognition sensors distributed over the length of the plough guide 4. This is generally effected in such a way that in continuous mining operation and with mining proceeding in the direction of the arrow A the plough installation always remains on the footwall horizon.

When optical sensor heads are used for the recognition sensors 20, as is preferred, all the relevant design features of this optical system, as described in DE-PS 38 41 524, may be utilised. The optical waveguides or fibre optics 22, which are constructed as fibre optic bundles, comprise both the fibre optics for the luminous radiation emitted by the transmitter station and the fibre optics for the relevant luminous radiation reflected to the receiver station in the scanning region of the respective recognition sensor, which is evaluated as a measured value by the electronic evaluation and control unit and which is utilised for controlling the adjusting cylinders. Light-emitting diodes or laser diodes may be employed as the light sources. The light sources or the transmitter stations do not need to be disposed together with the recognition sensors 20 on the plough- or machine guide. Rather, they may be spatially separated from the recognition sensors, i.e. disposed in a protected manner on the stowing side of the conveyor 2. The same applies to the receiver stations which receive the reflected light. When optical sensor heads are used for the recognition sensors they may be closed by an optical window in the form of a sapphire or the like, as is known. It is recommended that the recognition sensors 20 be disposed on the machine- or plough guide in the immediate vicinity of the footwall level in each case. Boom or outrigger control systems of the various known types of construction may be used for controlling the plough or mining installation. Other control devices which employ controllable actuating drives may also be used instead of boom or outrigger control systems, however. The level control system according to the invention is preferably intended for mining installations which are used in longwall face operations (longwall mining faces). It may also be used for short-wall operations, however.

All publications and patent applications mentioned herein are incorporated herein by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. An apparatus for adjusting a cutting horizon of a mining machine of the type which is guided along a machine guide positioned at a mining face having a footwall rock interface, the apparatus comprising;

a machine guide;

an electronic evaluation and control unit;

a plurality of recognition sensors to detect the footwall rock interface, said sensors being connected via transmission lines to said electronic evaluation and control unit to transmit measuring signals thereto;

a plurality of hydraulic adjusting cylinders having moveable pistons, said cylinders being connected to said electronic evaluation and control unit to receive an output therefrom and associated with said machine guide to adjust said machine guide relative to said mining face;

wherein said plurality of recognition sensors are disposed distributed along said machine guide, said electronic evaluation and control unit processes said measuring signals to produce said output, and said plurality of hydraulic adjusting cylinders use said output to adjust said machine guide and, thereby, the cutting horizon of the mining machine.

2. An apparatus according to claim 1 wherein said recognition sensors consist of optical sensor heads which detect different reflectances of footwall rock and coal.

3. An apparatus according to claim 1, wherein said machine guide consists of a plough guide which is disposed adjacent the cutting or mining face on a movable conveyor and which is provided with a sliding track, which sliding track can be supported on the footwall, to serve as a delimitation for the cut of the cutter, and on which sliding track said recognition sensors are disposed.

4. An apparatus according to claim 3, wherein said sliding track has a plurality of recesses and wherein said recognition sensors are disposed in said recesses.

5. An apparatus according to claim 4, wherein said sliding track is formed from sliding rails and said recognition sensors are disposed on face ends of said sliding rails.

6. An apparatus according to claim 4, wherein said recognition sensors are disposed over the length of said machine guide at spacings of 6–25 m in relation to each other.

7. An apparatus according to claim 4, wherein said recognition senors consists of optical sensor heads which detect different reflections of footwall rock and coal, said optical sensor heads are connected via optical waveguides or fibre optics to transmitter stations provided with light sources and to receiver stations which receive reflected light, wherein said machine guide has a movable conveyor, said transmitter and receiver stations are disposed on one of said machine guide or said conveyor, and said light sources are selected from the group consisting of light emitting diodes and laser diodes.

8. An apparatus according to claim 4, wherein said electronic evaluation and control unit which processes measuring signals of one or more recognition sensors, is connected to said adjusting cylinder or to a group of adjusting cylinders to transmit said output thereto for electrohydraulic actuation of said cylinders.

9. An apparatus according to claim 4, wherein said electronic evaluation and control unit is provided with an electronic device for determining average values from said measuring signals and for controlling said adjusting cylinders in accordance with said average values.

10. An apparatus according to claim 4, including displacement measuring sensors which are associated with said adjusting cylinders to determine the piston position of the cylinders and said sensors are connected, via a transmission line which transmits the displacement measurement signals, to the electronic evaluation and control unit, the arrangement being such that the electronic evaluation and control unit controls the piston stroke of the adjusting cylinders in a metered manner.

11. An apparatus according to claim 4, wherein said apparatus further comprises a boom or outrigger control system which is formed from advance mechanisms of a support frame, and a boom rod or outrigger assembly linked to said conveyor and supported and guided in said support frame.

12. An apparatus according to claim 3, wherein said sliding track is formed from sliding rails and said recognition sensors are disposed on face ends of said sliding rails.

13. An apparatus according to claim 12, wherein said recognition sensors are disposed over the length of said machine guide at spacings of 6–25 m in relation to each other.

14. An apparatus according to claim 12, wherein said recognition senors consists of optical sensor heads which detect different reflections of footwall rock and coal, said optical sensor heads are connected via optical waveguides or fibre optics to transmitter stations provided with light sources and to receiver stations which receive reflected light, wherein said machine guide has a movable conveyor, said transmitter and receiver stations are disposed on one of said machine guide or said conveyor, and said light sources are selected from the group consisting of light emitting diodes and laser diodes.

15. An apparatus according to claim 12, wherein said electronic evaluation and control unit which processes measuring signals of one or more recognition sensors, is connected to said adjusting cylinder or to a group of adjusting cylinders to transmit said output thereto for electrohydraulic actuation of said cylinders.

16. An apparatus according to claim 12, wherein said electronic evaluation and control unit is provided with an electronic device for determining average values from said measuring signals and for controlling said adjusting cylinders in accordance with said average values.

17. An apparatus according to claim 12, including displacement measuring sensors which are associated with said adjusting cylinders to determine the piston position of the cylinders and said sensors are connected, via a transmission line which transmits the displacement measurement signals, to the electronic evaluation and control unit, the arrangement being such that the electronic evaluation and control unit controls the piston stroke of the adjusting cylinders in a metered manner.

18. An apparatus according to claim 12, wherein said apparatus further comprises a boom or outrigger control system which is formed from advance mechanisms of a support frame, and a boom rod or outrigger assembly linked to said conveyor and supported and guided in said support frame.

19. An apparatus according to claim 3, wherein said recognition sensors are disposed over the length of said machine guide at spacings of 6–25 m in relation to each other.

20. An apparatus according to claim 3, wherein said recognition senors consists of optical sensor heads which detect different reflections of footwall rock and coal, said optical sensor heads are connected via optical waveguides or fibre optics to transmitter stations provided with light sources and to receiver stations which receive reflected light, wherein said machine guide has a movable conveyor, said transmitter and receiver stations are disposed on one of said machine guide or said conveyor, and said light sources are selected from the group consisting of light emitting diodes and laser diodes.

21. An apparatus according to claim 3, wherein said electronic evaluation and control unit which processes measuring signals of one or more recognition sensors, is connected to said adjusting cylinder or to a group of adjusting cylinders to transmit said output thereto for electrohydraulic actuation of said cylinders.

22. An apparatus according to claim 3, wherein said electronic evaluation and control unit is provided with an electronic device for determining average values from said measuring signals and for controlling said adjusting cylinders in accordance with said average values.

23. An apparatus according to claim 3, including displacement measuring sensors which are associated with said adjusting cylinders to determine the piston position of the cylinders and said sensors are connected, via a transmission line which transmits the displacement measurement signals, to the electronic evaluation and control unit, the arrangement being such that the electronic evaluation and control unit controls the piston stroke of the adjusting cylinders in a metered manner.

24. An apparatus according to claim 3, wherein said apparatus further comprises a boom or outrigger control system which is formed from advance mechanisms of a support frame, and a boom rod or outrigger assembly linked to said conveyor and supported and guided in said support frame.

25. An apparatus according to claim 2, in which the optical sensor heads are connected via optical waveguides or fibre optics to transmitter stations provided with light sources and to receiver stations which receive reflected light, wherein said machine guide has a movable conveyor, said transmitter and receiver stations are disposed on one of said machine guide or said conveyor, and said light sources are selected from the group consisting of light emitting diodes and laser diodes.

26. An apparatus according to claim 25, wherein said optical waveguides or fibre optics leading to said optical sensor heads are guided through below said conveyor to the stowing side of the latter.

27. An apparatus according to claim 26, wherein said electronic evaluation and control unit which processes measuring signals of one or more recognition sensors, is connected to said adjusting cylinder or to a group of adjusting cylinders to transmit said output thereto for electrohydraulic actuation of said cylinders.

28. An apparatus according to claim 26, wherein said electronic evaluation and control unit is provided with an electronic device for determining average values from said measuring signals and for controlling said adjusting cylinders in accordance with said average values.

29. An apparatus according to claim 26, including displacement measuring sensors which are associated with said adjusting cylinders to determine the piston position of the cylinders and said sensors are connected, via a transmission line which transmits the displacement measurement signals, to the electronic evaluation and control unit, the arrangement being such that the electronic evaluation and control unit controls the piston stroke of the adjusting cylinders in a metered manner.

30. An apparatus according to claim 26, wherein said apparatus further comprises a boom or outrigger control system which is formed from advance mechanisms of a support frame, and a boom rod or outrigger assembly linked to said conveyor and supported and guided in said support frame.

31. An apparatus according to claim 25, wherein said electronic evaluation and control unit which processes measuring signals of one or more recognition sensors, is connected to said adjusting cylinder or to a group of adjusting cylinders to transmit said output thereto for electrohydraulic actuation of said cylinders.

32. An apparatus according to claim 25, wherein said electronic evaluation and control unit is provided with an electronic device for determining average values from said measuring signals and for controlling said adjusting cylinders in accordance with said average values.

33. An apparatus according to claim 25, including displacement measuring sensors which are associated with said adjusting cylinders to determine the piston position of the cylinders and said sensors are connected, via a transmission line which transmits the displacement measurement signals, to the electronic evaluation and control unit, the arrangement being such that the electronic evaluation and control unit controls the piston stroke of the adjusting cylinders in a metered manner.

34. An apparatus according to claim 25, wherein said apparatus further comprises a boom or outrigger control system which is formed from advance mechanisms of a support frame, and a boom rod or outrigger assembly linked to said conveyor and supported and guided in said support frame.

35. An apparatus according to claim 2, wherein said mining installation has a movable conveyor on a side adjacent the mining face said machine guide being disposed on said movable conveyor and said recognition sensors being disposed on said machine guide.

36. An apparatus according to claim 35, wherein said recognition sensors are disposed at a lower portion of said machine guide, directly above the footwall.

37. An apparatus according to claim 36, wherein said machine guide consists of a plough guide which is disposed adjacent the cutting or mining face on said movable conveyor and which is provided with a sliding track, which sliding track can be supported on the footwall, to serve as a delimitation for the cut of the cutter, and on which sliding track said recognition sensors are disposed.

38. An apparatus according to claim 37, in which the optical sensor heads are connected via optical waveguides or fibre optics to transmitter stations provided with light sources and to receiver stations which receive reflected light, wherein said machine guide has a movable conveyor, said transmitter and receiver stations are disposed on one of said machine guide or said conveyor, and said light sources are selected from the group consisting of light emitting diodes and laser diodes.

39. An apparatus according to claim 35, wherein said machine guide consists of a plough guide which is disposed adjacent the cutting or mining face on said movable conveyor and which is provided with a sliding track, which sliding track can be supported on the footwall, to serve as a delimitation for the cut of the cutter, and on which sliding track said recognition sensors are disposed.

40. An apparatus according to claim 39, wherein said sliding track is formed from sliding rails and said recognition sensors are disposed on face ends of said sliding rails.

41. An apparatus according to claim 40, wherein said recognition sensors are disposed over the length of said machine guide at spacings of 6–25 m in relation to each other.

42. An apparatus according to claim 41, in which the optical sensor heads are connected via optical waveguides or fibre optics to transmitter stations provided with light sources and to receiver stations which receive reflected light, wherein said machine guide has a movable conveyor, said transmitter and receiver stations are disposed on one of said machine guide or said conveyor, and said light sources are selected from the group consisting of light emitting diodes and laser diodes.

43. An apparatus according to claim 42, wherein said electronic evaluation and control unit which processes measuring signals of one or more recognition sensors, is connected to said adjusting cylinder or to a group of adjusting cylinders to transmit said output thereto for electrohydraulic actuation of said cylinders.

44. An apparatus according to claim 43, wherein said electronic evaluation and control unit is provided with an electronic device for determining average values from said measuring signals and for controlling said adjusting cylinders in accordance with said average values.

45. An apparatus according to claim 44, including displacement measuring sensors which are associated with said adjusting cylinders to determine the piston position of the cylinders and said sensors are connected, via a transmission line which transmits the displacement measurement signals, to the electronic evaluation and control unit, the arrangement being such that the electronic evaluation and control unit controls the piston stroke of the adjusting cylinders in a metered manner.

46. An apparatus according to claim 45, wherein said apparatus further comprises a boom or outrigger control system which is formed from advance mechanisms of a support frame, and a boom rod or outrigger assembly linked to said conveyor and supported and guided in said support frame.

47. An apparatus according to claim 2, wherein said machine guide consists of a plough guide which is disposed adjacent the cutting or mining face on said movable conveyor and which is provided with a sliding track, which sliding track can be supported on the footwall, to serve as a delimitation for the cut of the cutter, and on which sliding track said recognition sensors are disposed.

48. An apparatus according to claim 2, wherein said recognition sensors are disposed over the length of said machine guide at spacings of 6–25 m in relation to each other.

49. An apparatus according to claim 2, wherein said electronic evaluation and control unit which processes measuring signals of one or more recognition sensors, is connected to said adjusting cylinder or to a group of adjusting cylinders to transmit said output thereto for electrohydraulic actuation of said cylinders.

50. An apparatus according to claim 2, wherein said electronic evaluation and control unit is provided with an electronic device for determining average values from said measuring signals and for controlling said adjusting cylinders in accordance with said average values.

51. An apparatus according to claim 2, including displacement measuring sensors which are associated with said adjusting cylinders to determine the piston position of the cylinders and said sensors are connected, via a transmission line which transmits the displacement measurement signals, to the electronic evaluation and control unit, the arrangement being such that the electronic evaluation and control unit controls the piston stroke of the adjusting cylinders in a metered manner.

52. An apparatus according to claim 2, wherein a apparatus further comprises a boom or outrigger control system which is formed from advance mechanisms of a support frame, and a boom rod or outrigger assembly linked to said conveyor and supported and guided in said support frame.

53. An apparatus according to claim 1, wherein said mining installation has a movable conveyor on a side adjacent the mining face said machine guide being disposed on said movable conveyor and said recognition sensors being disposed on said machine guide.

54. An apparatus according to claim 53 wherein said recognition sensors are disposed at a lower portion of said machine guide, directly above the footwall.

55. An apparatus according to claim 54, wherein said machine guide consists of a plough guide which is disposed adjacent the cutting or mining face on said movable conveyor and which is provided with a sliding track, which sliding track can be supported on the footwall, to serve as a delimitation for the cut of the cutter, and on which sliding track said recognition sensors are disposed.

56. An apparatus according to claim 54, wherein said recognition sensors are disposed over the length of said machine guide at spacings of 6–25 m in relation to each other.

57. An apparatus according to claim 53, wherein said machine guide consists of a plough guide which is disposed adjacent the cutting or mining face on said movable conveyor and which is provided with a sliding track, which sliding track can be supported on the footwall, to serve as a delimitation for the cut of the cutter, and on which sliding track said recognition sensors are disposed.

58. An apparatus according to claim 53, wherein said recognition sensors are disposed over the length of said machine guide at spacings of 6–25 m in relation to each other.

59. An apparatus according to claim 53, wherein said recognition senors consists of optical sensor heads which detect different reflections of footwall rock and coal, said optical sensor heads are connected via optical waveguides or fibre optics to transmitter stations provided with light sources and to receiver stations which receive reflected light, wherein said machine guide has a movable conveyor, said transmitter and receiver stations are disposed on one of said machine guide or said conveyor, and said light sources are selected from the group consisting of light emitting diodes and laser diodes.

60. An apparatus according to claim 53, wherein said electronic evaluation and control unit which processes measuring signals of one or more recognition sensors, is connected to said adjusting cylinder or to a group of adjusting cylinders to transmit said output thereto for electrohydraulic actuation of said cylinders.

61. An apparatus according to claim 53, wherein said electronic evaluation and control unit is provided with an electronic device for determining average values from said measuring signals and for controlling said adjusting cylinders in accordance with said average values.

62. An apparatus according to claim 53, including displacement measuring sensors which are associated with said adjusting cylinders to determine the piston position of the cylinders and said sensors are connected, via a transmission line which transmits the displacement measurement signals, to the electronic evaluation and control unit, the arrangement being such that the electronic evaluation and control unit controls the piston stroke of the adjusting cylinders in a metered manner.

63. An apparatus according to claim 53, wherein said apparatus further comprises a boom or outrigger control system which is formed from advance mechanisms of a support frame, and a boom rod or outrigger assembly linked to said conveyor and supported and guided in said support frame.

64. An apparatus according to claim 1, wherein said recognition sensors are disposed over the length of said machine guide at spacings of 6–25 m in relation to each other.

65. An apparatus according to claim 64, wherein said spacings of said sensors is 10–15 m.

66. An apparatus according to claim 64, wherein said recognition senors consists of optical sensor heads which detect different reflections of footwall rock and coal, said optical sensor heads are connected via optical waveguides or fibre optics to transmitter stations provided with light sources and to receiver stations which receive reflected light, wherein said machine guide has a movable conveyor, said transmitter and receiver stations are disposed on one of said machine guide or said conveyor, and said light sources are selected from the group consisting of light emitting diodes and laser diodes.

67. An apparatus according to claim 64, wherein said electronic evaluation and control unit which processes measuring signals of one or more recognition sensors, is connected to said adjusting cylinder or to a group of adjusting cylinders to transmit said output thereto for electrohydraulic actuation of said cylinders.

68. An apparatus according to claim 64, wherein said electronic evaluation and control unit is provided with an electronic device for determining average values from said measuring signals and for controlling said adjusting cylinders in accordance with said average values.

69. An apparatus according to claim 64, including displacement measuring sensors which are associated with said adjusting cylinders to determine the piston position of the cylinders and said sensors are connected, via a transmission line which transmits the displacement measurement signals, to the electronic evaluation and control unit, the arrangement being such that the electronic evaluation and control unit controls the piston stroke of the adjusting cylinders in a metered manner.

70. An apparatus according to claim 64, wherein said apparatus further comprises a boom or outrigger control system which is formed from advance mechanisms of a support frame, and a boom rod or outrigger assembly linked to a conveyor and supported and guided in said support frame.

71. An apparatus according to claim 1, wherein said electronic evaluation and control unit which processes measuring signals of one or more recognition sensors, is connected to said adjusting cylinder or to a group of adjusting cylinders to transmit said output thereto for electrohydraulic actuation of said cylinders.

72. An apparatus according to claim 71, wherein said electronic evaluation and control unit is provided with an electronic device for determining average values from said measuring signals and for controlling said adjusting cylinders in accordance with said average values.

73. An apparatus according to claim 71, including displacement measuring sensors which are associated with said adjusting cylinders to determine the piston position of the cylinders and said sensors are connected, via a transmission line which transmits the displacement measurement signals, to the electronic evaluation and control unit, the arrangement being such that the electronic evaluation and control unit controls the piston stroke of the adjusting cylinders in a metered manner.

74. An apparatus according to claim 71, wherein a apparatus further comprises a boom or outrigger control system which is formed from advance mechanisms of a support frame, and a boom rod or outrigger assembly linked to said conveyor and supported and guided in said support frame.

75. An apparatus according to claim 1, wherein said electronic evaluation and control unit is provided with an electronic device for determining average values from said measuring signals and for controlling said adjusting cylinders in accordance with said average values.

76. An apparatus according to claim 75, including displacement measuring sensors which are associated with said adjusting cylinders to determine the piston position of the cylinders and said sensors are connected, via a transmission line which transmits the displacement measurement signals, to the electronic evaluation and control unit, the arrangement being such that the electronic evaluation and control unit controls the piston stroke of the adjusting cylinders in a metered manner.

77. An apparatus according to claim 75, wherein a apparatus further comprises a boom or outrigger control system which is formed from advance mechanisms of a support frame, and a boom rod or outrigger assembly linked to said conveyor and supported and guided in said support frame.

78. An apparatus according to claim 1, including displacement measuring sensors which are associated with said adjusting cylinders to determine the piston position of the cylinders and said sensors are connected, via a transmission line which transmits the displacement measurement signals, to the electronic evaluation and control unit, the arrangement being such that the electronic evaluation and control unit controls the piston stroke of the adjusting cylinders in a metered manner.

79. An apparatus according to claim 78, wherein a apparatus further comprises a boom or outrigger control system which is formed from advance mechanisms of a support frame, and a boom rod or outrigger assembly linked to said conveyor and supported and guided in said support frame.

80. An apparatus according to claim 1, wherein said apparatus further comprises a boom or outrigger control system which is formed from advance mechanisms of a support frame, and a boom rod or outrigger assembly linked to a conveyor and supported and guided in said support frame.

* * * * *